United States Patent [19]

Sharp

[11] Patent Number: 5,052,690

[45] Date of Patent: Oct. 1, 1991

[54] GOLF PUTTER WITH ALIGNMENT MEANS

[76] Inventor: Jerry R. Sharp, 17315 Broken Back Dr., Crosby, Tex. 77532

[21] Appl. No.: 647,705

[22] Filed: Jan. 29, 1991

[51] Int. Cl.[5] ..... A63B 69/36

[52] U.S. Cl. ..... 273/183 D; 273/163 A

[58] Field of Search ..... 273/183 D, 163 A, 164, 273/163 R, 183 E, 194 R, 194 A, 194 B

[56] References Cited

U.S. PATENT DOCUMENTS

| | | | |
|---|---|---|---|
| 2,463,798 | 3/1949 | Paisley | 273/163 |
| 2,771,678 | 11/1956 | Hansen | 271/163 |
| 2,898,109 | 8/1959 | Williams | 273/163 |
| 3,042,409 | 7/1962 | Johnson | 273/164 |
| 3,118,678 | 1/1964 | Rohr | 273/163 |
| 3,170,698 | 2/1965 | Schoeffler | 273/163 |
| 3,198,525 | 8/1965 | Smith | 273/163 |
| 3,273,891 | 9/1966 | Grim | 273/183 D |
| 3,292,928 | 12/1966 | Billen | 273/163 |
| 3,549,300 | 12/1970 | Pelz | 273/162 |
| 3,951,415 | 4/1976 | Stuart | 273/183 |
| 4,167,268 | 9/1977 | Lorang | 273/163 |
| 4,789,158 | 12/1988 | Chiesa | 273/163 A |

*Primary Examiner*—George J. Marlo

[57] ABSTRACT

A golf club alignment device for showing a target area of a golf ball to be impacted by a golf club has a base head with a center mark calibrated to a center line of a securely mounted reflective plate having a mirror quality finish angled back from the corresponding striking surface of the club head, a centering scale, silhouetted at the base portion of the reflective plate, made up of short lines, 0.125 inch spaced increment deviations on either side of the center line in progressive numerical order to allow the golfer to compensate for contours of putting surfaces, a grip reasonably secured to a shaft, of the club head having at a selected distance above the club head to the shaft, a centering standard projecting horizontally forward and parallel to the club head, an alignment mark existing near out board end of the centering standard, calibrated to the center mark of the club head, also calibrated to center line of the reflective plate, in conjunction with the reflection of alignment mark of the centering standard, thus subsequently positioning the corresponding striking surface of club head perpendicular to the reflection of the target or achieving a misaligned putt by using an offset of the centering scale right or left of center line for compensating for contoured putting surfaces of the putt being negotiated.

4 Claims, 8 Drawing Sheets

26
27
12
15
14
22
17
16

Fig 7-Correct Putting Stroke
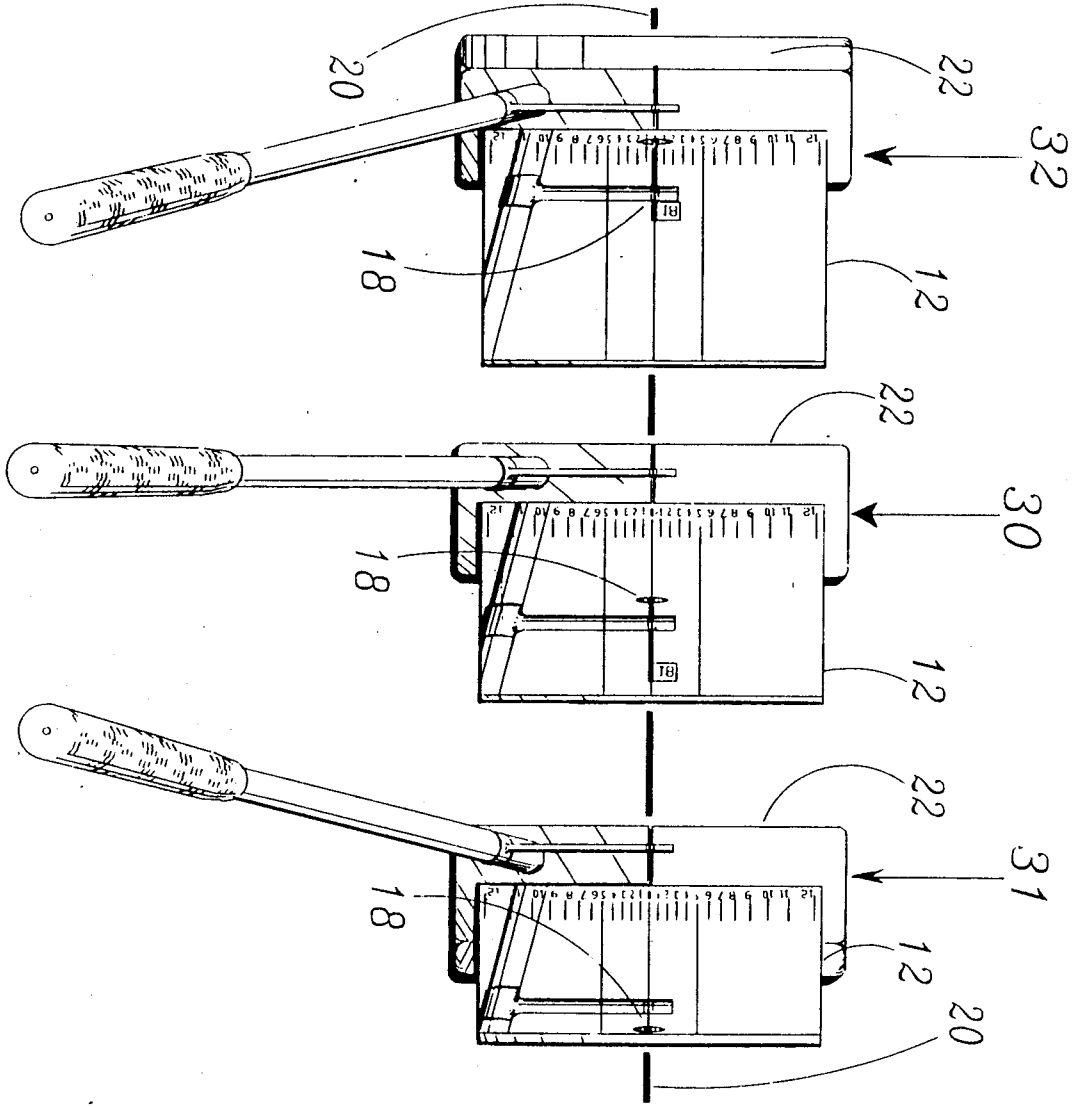

Fig 8-Incorrect Putting Stroke
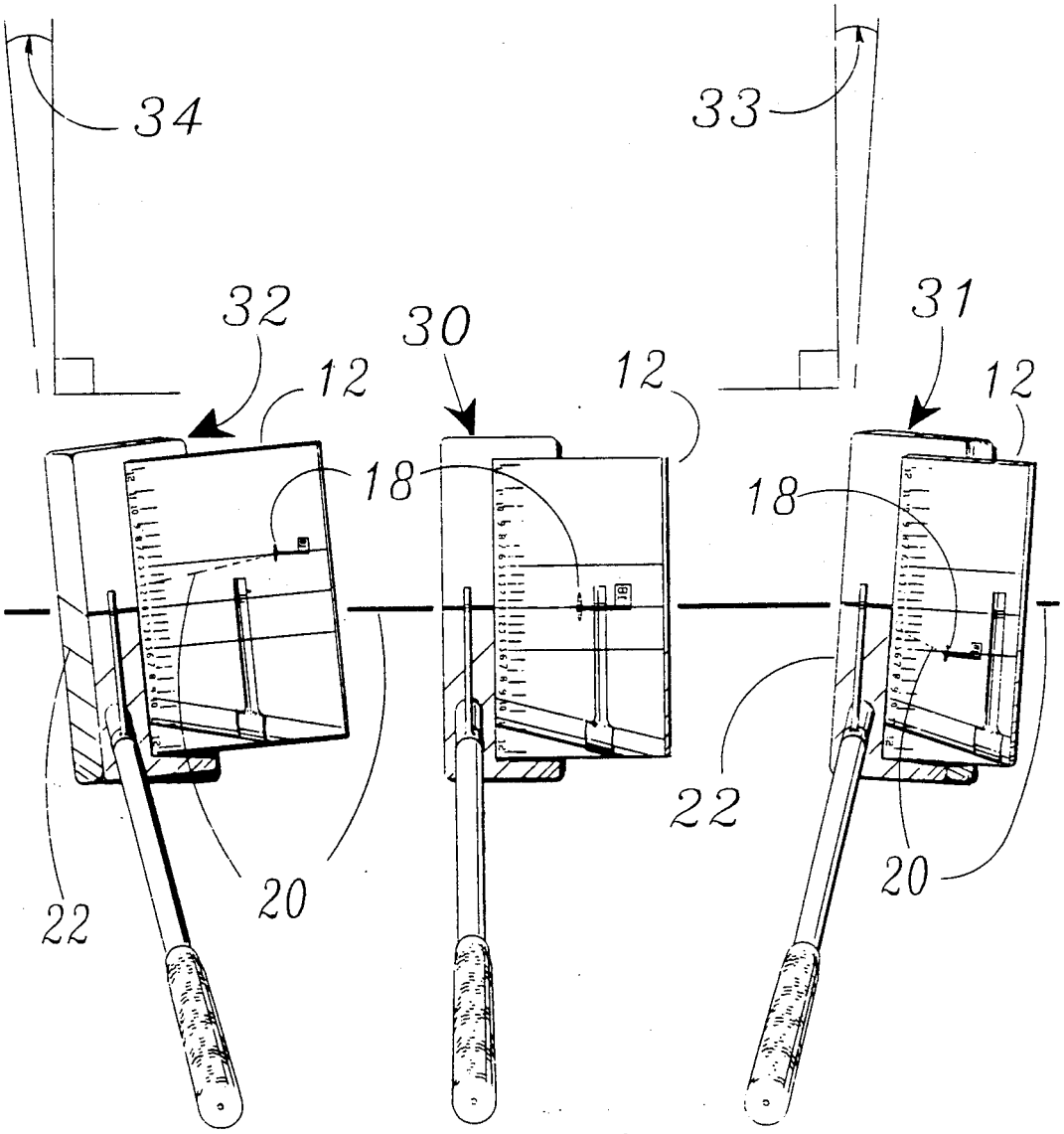

GOLF PUTTER WITH ALIGNMENT MEANS

BACKGROUND-FIELD OF INVENTION

The present invention relates to a golf club putter used for putting, having a novel aligning device for the purpose of aligning the putter accurately to a specific target or practicing and developing a proper putting stroke. Specifically, the present invention features an alignment device that allows the user to keep the striking surface of the club head perpendicular to a target throughout the putting stroke, while detecting any deviation from alignment.

BACKGROUND-DESCRIPTION OF PRIOR ART

Ever since the game of golf was invented golfers have tried to improve their game, by purchasing newer and better golf clubs and training aids, especially when it comes to putting.

It is common knowledge, to those skilled in the art, that a correct putting stroke is achieved by maintaining the club head in a path along a target line. The striking surface of the club head must be perpendicular to the target throughout the address, back swing, impact, and follow through. These features are basic and essential fundamentals to a proper putting stroke. To acquire a proper putting stroke one must know what a proper putting stroke feels like. An improper putting stroke is a common flaw among the average golf enthusiast and beginning golfer. In the past, these flaws have been corrected by the continued use and expense of a teaching professional. This was achieved by explanation and demonstration of the proper techniques for a putting stroke. The problem with this technique is, once the golfer has left the teaching professional, he has no way of knowing whether or not he is reproducing a proper putting stroke. In addition, when a golfer is in a position to execute a putt, his perception of a target line is often distorted due to his surroundings on the field of play.

In the past, golfers had to depend on perception of a target line on a putting surface. More strokes are lost with conventional putters on putting greens than anywhere else on the golf course. A golfer cannot ensure by his perception, while in position to execute a putt, if his putting stroke is exactly along the target line or if the striking surface of the club head is exactly perpendicular to the target. Another flaw in a golfer's putting technique is the relationship of the head and body posture. It is common knowledge, to those skilled in the art, that the golfer's head should be in a position directly over the ball and his eyes in line with the target. Golfers are dependent on their perception to achieve alignment with conventional putters. Golfers are never sure if their head and eyes are exactly in the position directly in line and over the ball. Another flaw of novice and even some seasoned golfers is impatience. They sometimes tend to prematurely look up at the target just before the club head impacts the ball. The most common excuse claimed by golfers is, "I looked up."

The apparatus of the present invention corrects these flaws by ensuring accurate perception of a target line when the user is in position to execute the putt, and by disciplining the golfer to keep his focus directly over and down on the ball. The present invention allows the user to accurately maintain the club head in a path along a target line. The present invention gives the user assurance that the striking surface of the club head is perpendicular throughout the address, back swing, impact, and follow through of a complete and proper putting stroke. The present invention permits the user to make all alignments while in a position to execute the putt. The present invention allows the user to know what a proper putting stroke feels like, without the aid or continued expense of a teaching professional. As a result, proper use of the present invention will subsequently improve the user's game.

Mechanical devices have been invented to train a golfer's putting stroke. These consist of guide rails to guide the arc of the putting stroke, such as U.S. Pat. No. 4,583,738 Fava (1986). The problem with this type of mechanical device is that it restricts the feel of a natural putting stroke. It is cumbersome, bulky, and impractical to use on a golf course putting green. A golfer's putting stroke becomes addicted or dependent to this rail, away from which the stroke will waver. The light muscle exertion of a putting stroke is more muscle memory or feel, rather than hard core training of muscle adaptation. The use of this guided rail device provides no assurance of the striking surface maintaining a perpendicular orientation in all phases of the stroke, thereby allowing the possibility of training errors into ones putting stroke. Furthermore, the user is still subject to optical distortions of terrain and background view during the address of the ball.

The apparatus of the present invention is practical, easy to use and understand, even by novice golfers. The apparatus of the present invention takes the guess work out of a golfer's perception by eliminating optical distortions of terrain and background. The apparatus of the present invention allows a golfer to practice a natural, unrestricted putting stroke, while maintaining the striking surface of the putter perpendicular to the target. This is fundamentally essential to a correct putting stroke.

U.S. Pat. No. 1,331,499 Hartford (1920), for example, discloses a golf putter device with a frame-like stand, an adjustable pointer to the hole, and a dial indicator to detect alignment from the rear of the putt being negotiated. The problem with this device is the alignment procedure. The user aligns the putter from the rear. After the user takes the putter away from its stand, he could unknowingly move the club head slightly out of alignment since he has left the alignment area. A two degree error, undetected by this device, on a 10 foot putt will result in the ball rolling approximately 4.2 inches off the target line. It is common knowledge, to those skilled in the art, that this is more than enough distance to cause a missed putt. Any error caused by moving the putter when the golfer addresses the ball, will be amplified with increased distance. This patent also assumes that the golfer will have a correct putting stroke. The golfer has no way of knowing if the striking surface of the club head is aligned exactly perpendicular to the target line during the back swing, impact, and follow through, or if his swing arc is in line with the putt being negotiated. The 1920 Hartford patent is now illegal in USGA Tournaments, because of adjustable parts.

The apparatus of the present invention detects errors in alignment during the setup, while the golfer is in a position to execute the putt. The apparatus of the present invention allows the golfer to assure a proper swing arc while maintaining the striking surface of the club head perpendicular to the target during the back swing, impact, and follow through, thus increasing his chances of a successful putt. The apparatus of the present invention complies within the specifications of the USGA.

U.S. Pat. No. 4,712,798 Preato (1987), for example, discloses a golf putter with an adjustable shaft and a triangular shaped club head with a prism on the upper surface for the purpose of centering the golf ball on the striking surface, as mentioned in Claim 1, Line 25. It also includes a weight receiving cavity for weight adjustment. Although the putter seems to be symmetrical and balanced, there is no way a golfer can make sure that the striking surface of the club head is perpendicular to the target for two reasons:

(1) the prism device is designed to center the ball on the striking surface of the putter only for balance reasons, as stated in its SUMMARY OF THE INVENTION, Line 48, also stated in the DESCRIPTION OF THE PREFERRED EMBODIMENT, Line 42, and furthermore stated in CLAIM 1, Line 25; and (2) the aim to the target is considered to be in a conventional style and manner as stated in the DESCRIPTION OF THE PREFERRED EMBODIMENT, Line 42.

The prism device is designed to glow or illuminate when the golf ball is centered on the striking surface, no matter where it is aimed. This is an extravagent method of centering a golf ball to the striking surface of a golf club putter. Most conventional putters come with a center mark of balance for this purpose. The prism device has no effect on aim or alignment to a target. The apparatus of the present invention over comes the disadvantages just mentioned. The apparatus of the present invention permits the user to accurately align the striking surface of the club head perpendicular to the target, thus aiming the golf club and the golf ball at the target. The present invention when properly used teaches a proper golf putting stroke. Its novel alignment features allow the golfer to align the striking surface of the club head perpendicular to the target line throughout the putting stroke. The present invention further allows the user to reproduce correct head and body posture. The present invention, through proper use, disciplines the user to maintain his focus on the ball throughout the putting stroke. The alignment features of the present invention will allow the user to obtain the same exact head and body position every time the user addresses the ball. This will allow the user to achieve consistency and accuracy. The apparatus of the present invention enables a golfer, regardless of his skill level and without the aid or continued use and expense of a teaching professional, to practice and refine a proper putting stroke in a repetitive fashion for reproducible results. The present invention allows the user to putt a golf ball accurately to a target, thus having more successful putts.

According to the USGA 1990 Rules of Golf, Appendix II, Sections 4–10, in summary, says that exceptions are made for putters to have alignment devices, only as long as they are fixed with non-adjustable or moving parts, and are a permanent part of the putter. The apparatus of the present invention meets the requirements of this standard. The 1990 USGA rule allows the present invention to be legal for tournament play.

OBJECTIVES AND ADVANTAGES

Accordingly, besides the objectives and advantages of the sure alignment golf club putter described in my above patent, several objectives and advantages of the present invention are:

(a) to provide a novel golf club putter which allows its user to align the swing arc of a putting stroke along a target line;

(b) to provide a novel golf club putter which allows its user to ensure that the striking surface of the club head is perpendicular to the target throughout the putting stroke;

(c) to provide a novel golf club putter which allows its user to reproduce the same alignment of head and body posture in relationship to a ball every time;

(d) to provide a novel golf club putter which allows its user to detect any deviation in stroke and alignment;

(e) to provide a novel golf club putter which can be used as a training aid for practicing and refining a complete and proper putting stroke, without continued expense from a teaching professional's services;

(f) to provide a novel golf club putter which is practical for practicing on any given putting surface;

(g) to provide a novel golf club putter which is of simple, yet sturdy design and construction, capable of fitting any standard golf bag;

(h) to provide a novel golf club putter which allows its user to practice and refine a correct putting stroke which, in turn, will result in consistent, more accurate, and successful putting;

(i) to provide a novel golf club putter which allows its user to discipline his focus directly over the ball;

(j) to provide a novel golf club putter which detects deviations in alignment and allows its user to purposely and accurately align the putter, compensating for sloping putting surfaces;

(k) to provide a novel golf club putter which allows its user to feel a proper, unrestricted putting stroke, naturally;

(l) to provide a novel golf club putter which allows its user to accurately set up and align the putter while in a position to execute the putt being negotiated;

(m) to provide a novel golf club putter which permits its user to have a accurate perception of a target line while in position to execute the putt; and (n) to provide a novel golf club putter which permits the user to accurately align and putt a ball to a target;

It should be understood by those skilled in the art that objectives and advantages specifically enumerated herein are achieved by the invention as disclosed and embodied herein. Further, it will be found that with this invention for putting a ball on a given surface to a given target, its user can become habituated to a proper putting stroke, have a more reliable perception of the target line, and will experience more consistent, accurate, and successful putting.

It should be also understood that the apparatus of the present invention will be found to be more accurate in putting a golf ball to a target than conventional putters.

It should be noted to all that the apparatus of the present invention can be designed and manufactured for users of all sizes, right or lefthanded.

It should be yet noted that attachable components of the featured novel alignment device of the present invention, can modify conventional golf club putters to conform to the specifications of the present invention, achieving the same objectives and advantages stated herein;

It should be also noted that other styles, shapes, and sizes of club heads and variations of putters can be adapted or modified with the novel alignment features of the present invention, and meet the same objectives and advantages of the present invention.

It should be further noted that the foregoing general descriptions and following detailed descriptions and terminology are exemplary and explanatory of the invention and are not intended to be restrictive thereof. The accompanying drawings referred to herein and constituting a part hereof, illustrate a basic version with the preferred embodiment of the invention, and together with the description, serve to explain the theory, method, and principle of the invention. This basic version achieves the objectives, advantages, and notations stated within the scope of the theory and method of the invention described in my above patent. It should be apparent to those skilled in the art that further objectives and advantages will become evident from a consideration of the ensuing descriptions and drawings.

BRIEF DESCRIPTION OF DRAWINGS

In the drawings closely related figs. have the same number but different alphabetical suffixes.

FIG. 3A is an enlarged, detailed, break away view of a base portion of the putter according to the present invention as shown in FIG. 3.

FIG. 5 is a top view of the putter according to the present invention and target area from a user's perspective of a putt being negotiated.

FIG. 5A is an enlarged, detailed, break away view of the base portion of the putter according to the present invention broken from target area.

FIG. 6 is a similar top view of the putter according to the present invention of the same putt, having a left to right inclined putting surface.

FIG. 6A is an enlarged, detailed, break away view of the base portion of the putter according to the present invention broken from target area.

FIGS. 7 and 8 serve to show state of the art training methods being claimed of the apparatus of the present invention.

FIG. 7 is a top view of the putter according to the present invention showing its relationship to a target line in various phases of a correct putting stroke from a user's perspective.

FIG. 8 is a similiar top view of the putter according to the present invention showing its relationship to a target and target line of an incorrect putting stroke.

REFERENCE NUMERALS IN DRAWINGS

Figure 1:
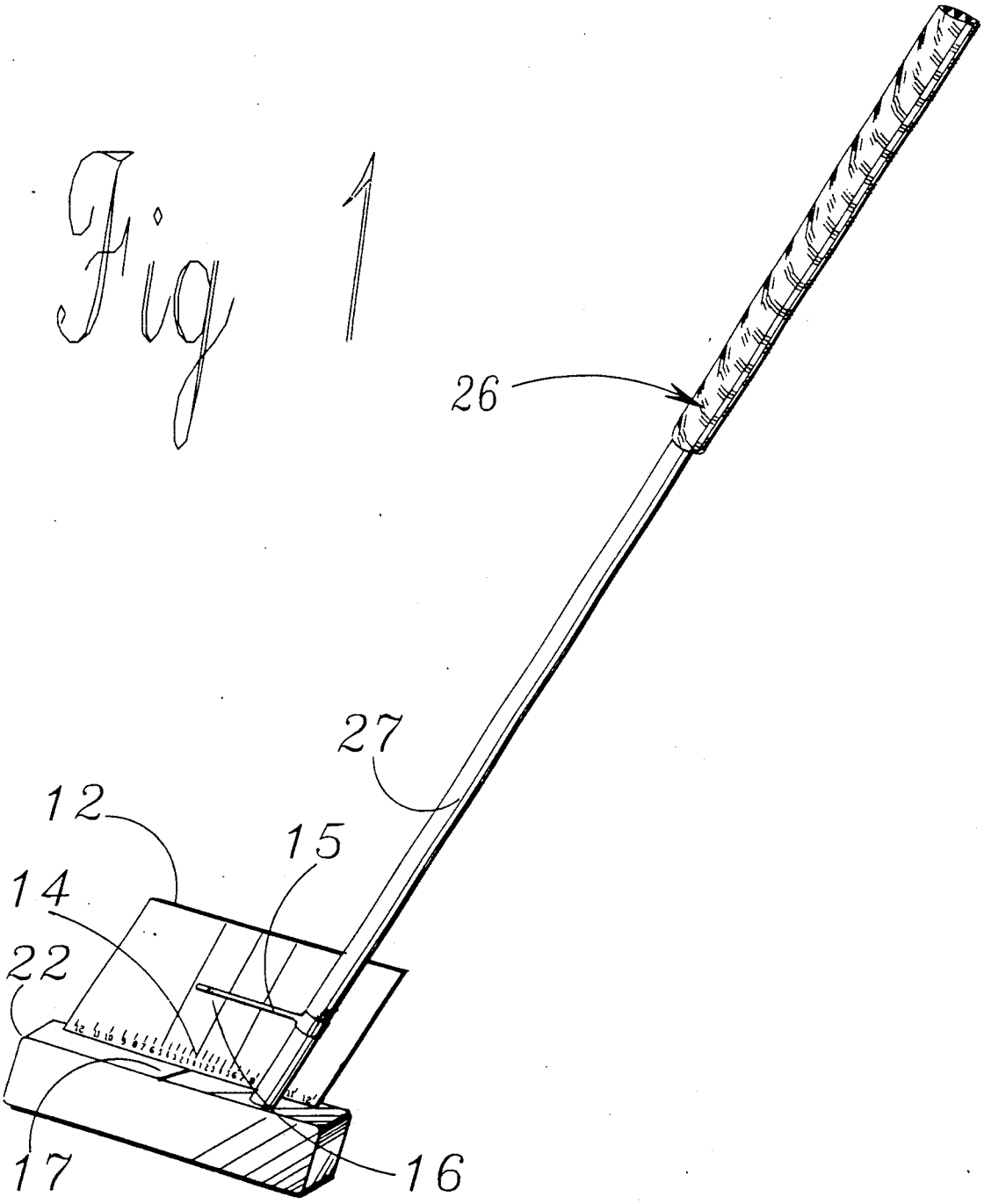
FIG. 1 is an oblique elevated view of a basic version to one embodiment of the present invention.

11. caddie
12. reflective plate or mirror
13. golfer
14. centering scale or degree scale
15. head alignment centering standard
16. head alignment mark
17. center mark
18. target
19. golfers line of view
20. target line
21. ball
22. club head
23. acorn
24. right alternative target lines
25. predicted right trajectory line
26. sure alignment golf club putter
27. shaft
28. angle from target 18, to alternative target line 24 angle of striking surface of club head 22, away from perpendicular alignment
30. address and impact phase of a putting stroke
31. back swing phase of a putting stroke
32. follow through phase of a putting stroke
33. back swing deviation angle
34. follow through deviation angle

DETAILED DESCRIPTION OF THE PREFERRED EMBODIMENT

FIG. 1 illustrates a basic version of a sure alignment golf club putter 26, according to the present invention. Putter 26 comprises a shaft 27 mounted to a club head 22 with the preferred embodiments of the featured alignment components attached respectively. The featured components are comprised of a mirror or reflective plate 12 mounted to the top portion of club head 22, and a centering scale 14 silhouetted near the base area of reflective plate 12. Reflective plate 12 is angled back to accommodate the user with a reflection or view of a target area. The featured components are further comprised of a head alignment centering standard 15 attached to shaft 27. Centering standard 15 having a head alignment mark 16 existing in line, a fixed distance directly above a center mark 17 located on the top center portion of club head 22. Mark 16 further exists in line with a zero or neutral mark of centering scale 14. The surface of reflective plate 12, although angled back, exists in a parallel orientation from a striking surface of club head 22.

Figure 2A:
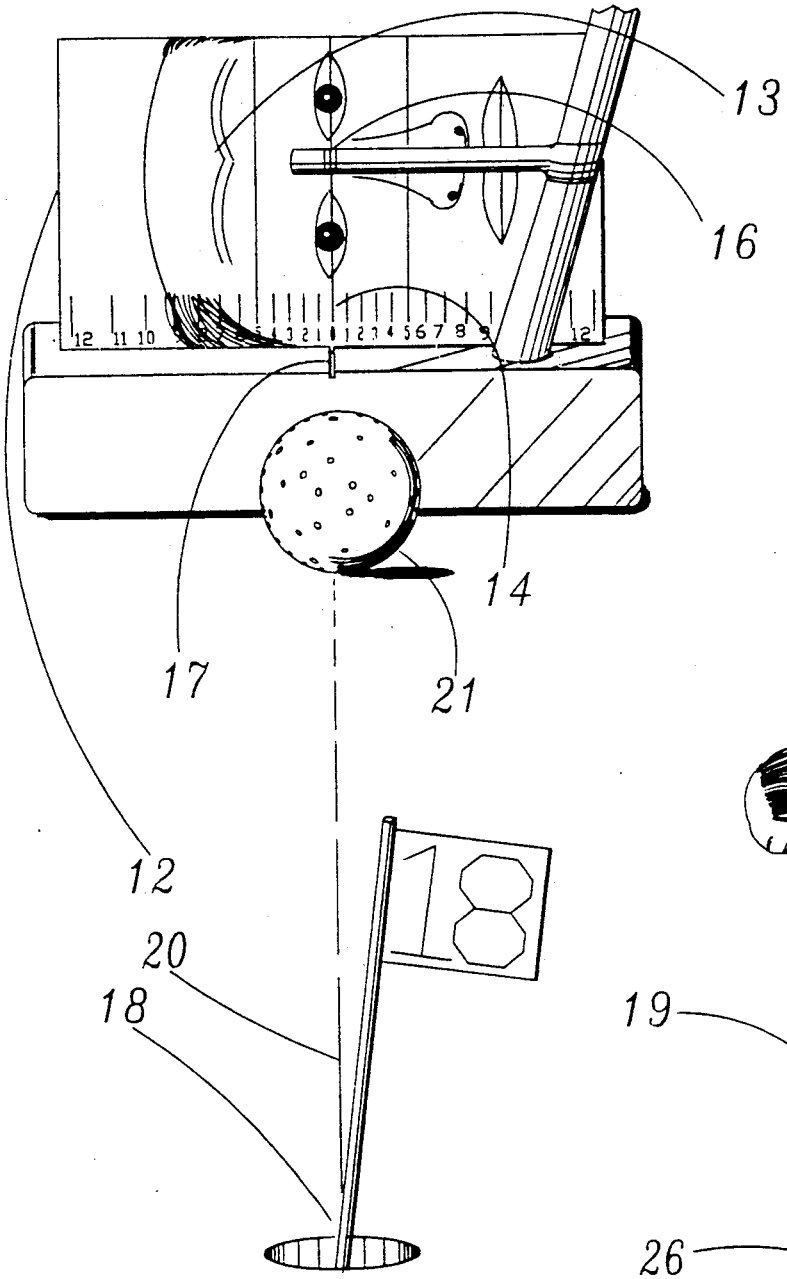
FIG. 2A is an enlarged, detailed, break away view of the base portion of the putter according to the present invention shown in FIG. 2.
Figure 2:
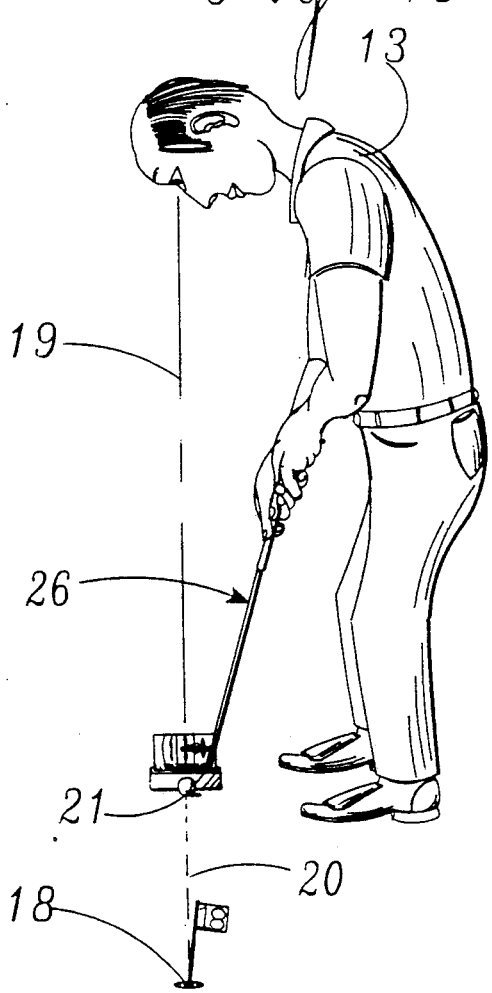
FIG. 2 is an elevated front view showing a golfer using the sure alignment golf club putter according to the present invention to align a putt to a target.

FIG. 2 shows a golfer 13 using putter 26 to align a ball 21 to a target 18. This further shows a golfer's line of view 19 and a target line 20 in relationship to head and body posture of golfer 13.

FIG. 2A magnifies the featured components of the preferred embodiment functioning from this angle. Reflective plate 12 exhibits a reflection of golfer 13. Alignment mark 16 exists directly over and in line with zero or neutral mark of centering scale 14. Center mark 17 is aligned to ball 21. Further showing, in reflective plate 12, golfer 13 viewing, centering, and aligning mark 16 with center mark 17 and zero of center scale 14. This alignment results in golfer 13 positioning his head directly over ball 21, in line with target 18, as fully shown in FIG. 2.

FIG. 2A further shows that plate 12 reflects eyes of golfer 13, directly over ball 21, in line with target 18 from this angle.

FIG. 2A clearly shows centering scale 14 comprising of a plurality of marks constituting an increment scale of angular measurement, having zero or neutral mark in line with center mark 17, in a perpendicular orientation to striking surface of club head 22. Marks of scale 14 are further comprised of a polarity of increment deviations right and left of zero mark in numerical order respectfully whereby golfer 13 can measurably detect deviations in alignment and accurately compensate for contours and breaks associated with putting surfaces.

Figures 3, 3D:
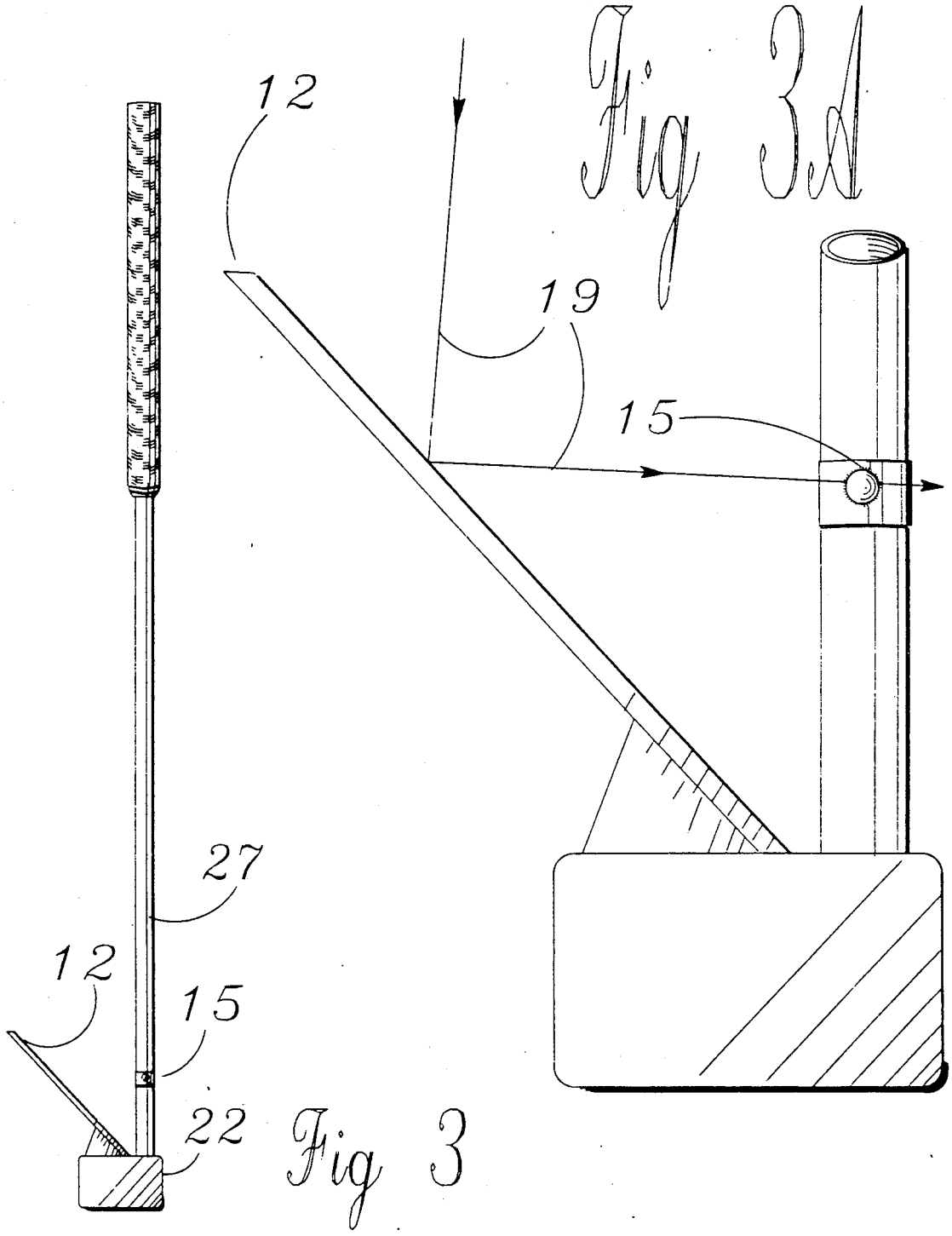
FIG. 3 is a direct side view of the putter in accordance with the present invention.

FIG. 3 shows the back angle of reflective plate 12 attached to the top portion of club head 22. It further shows a general placement of centering standard 15 attached to shaft 27.

FIG. 3A shows how golfer's viewing line 19 is reflected against plate 12 past centering standard 15.

Figure 4A:
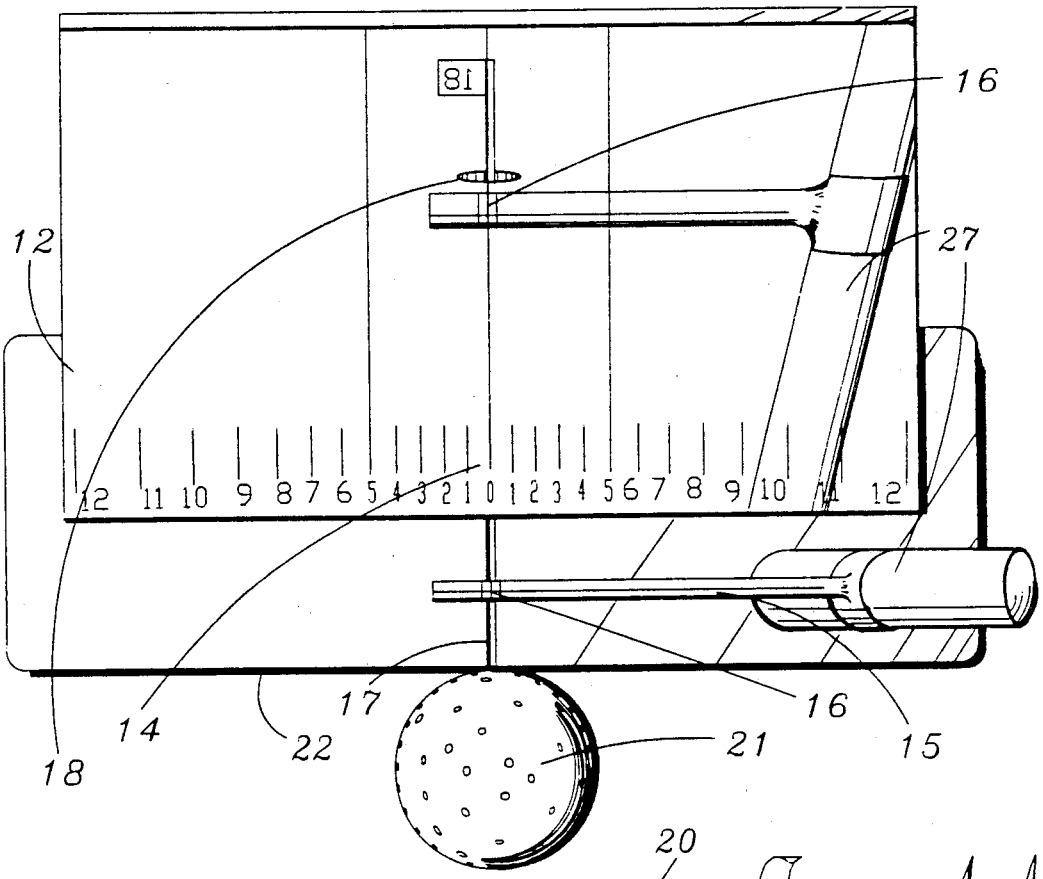
FIG. 4A is an enlarged, detailed, break away view of the base portion of the putter according to the present invention as shown in FIG. 4.
Figure 4:
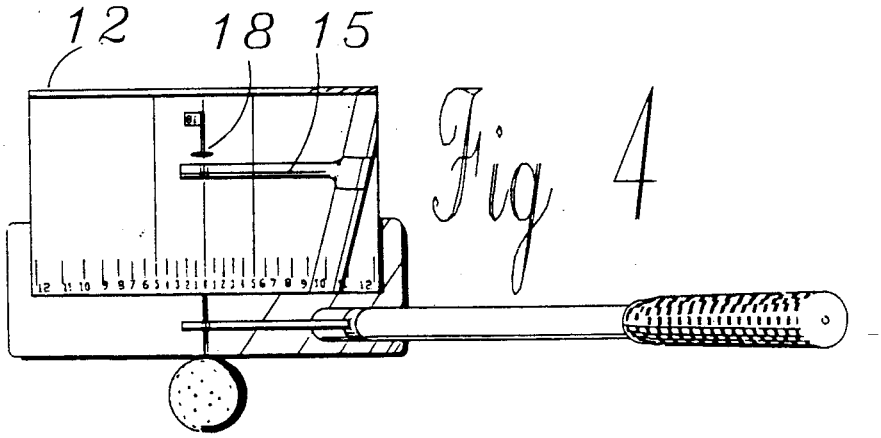
FIG. 4 is a top view of the putter according to the present invention aligned with a ball to a target.

FIG. 4 discloses in plate 12 a reflection of target 18 and a reflection of centering standard 15 from this angle.

FIG. 4A shows striking surface of club head 22 perpendicular to target line 20. In this example six aligning points of reference are viewed: (a.) alignment mark 16; (b.) center mark 17; (c.) ball 21; (d.) a reflection of alignment mark 16; (e.) zero of centering scale 14; and (f.) reflection of target 18. Perpendicular positioning of club head 22 is achieved when alignment mark 16 is in line with center mark 17 to ball 21; further with reflection of alignment mark 16 lined up with reflection of target 18 to zero of centering scale 14. These six points of reference aligned in a linear arrangement will result in perfect alignment to target 18 with correct head and body posture.

Figure 5:
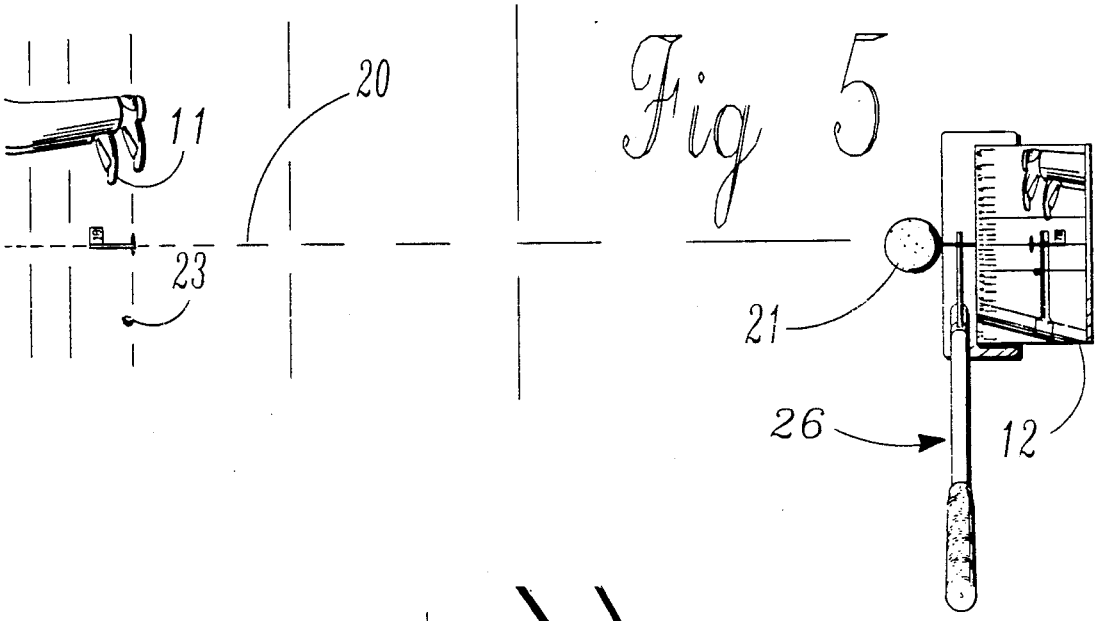
FIGS. 5, 5A, 6 and 6A serve to show functions or methods being claimed by the apparatus of the present invention.

FIG. 5 shows correct positioning of a putt including target line 20 from a user or golfer's perspective. Introducing a caddie 11 and an acorn 23 existing in target area as objects of reference for the purpose of further illustrations and functions of reflective plate 12.

Figure 5A:
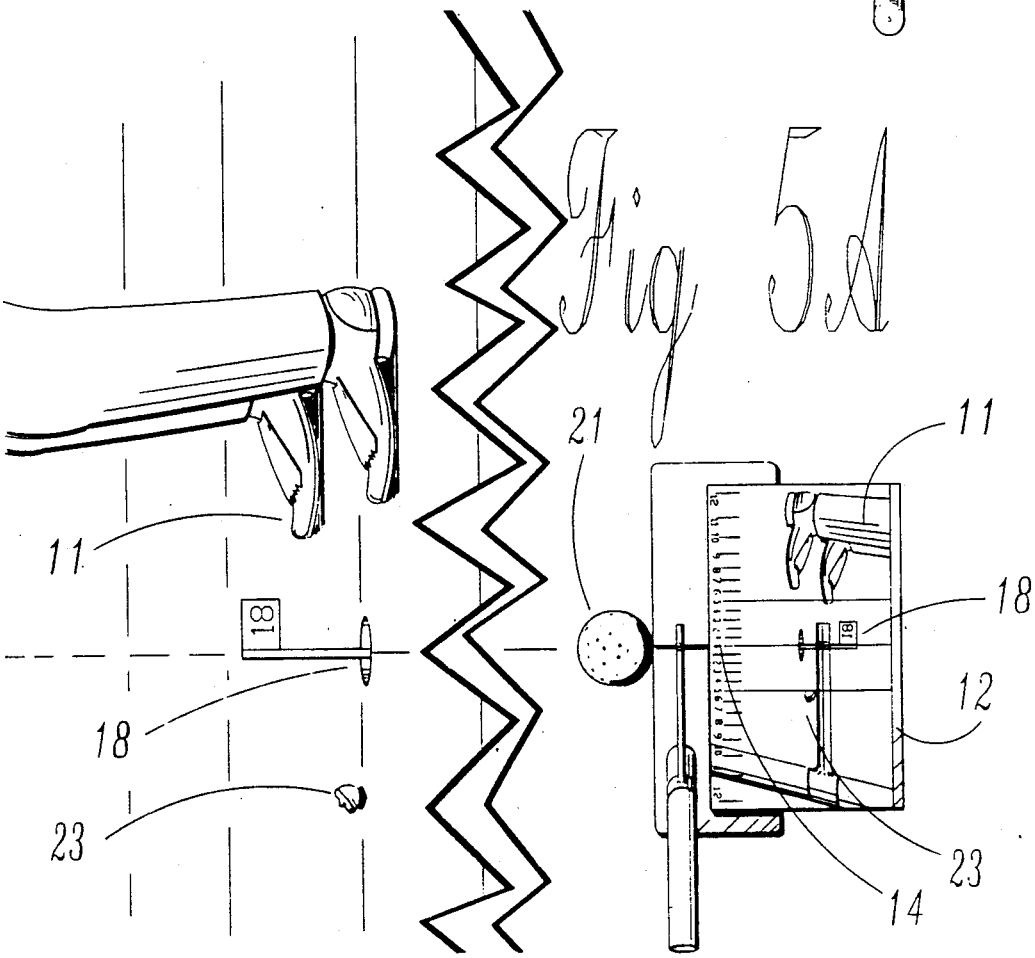

FIG. 5A shows according to centering scale 14 in plate 12, a reflection of the feet of caddie 11 existing right of target 18, and a reflection of acorn 23 existing left of target 18.

Figure 6:
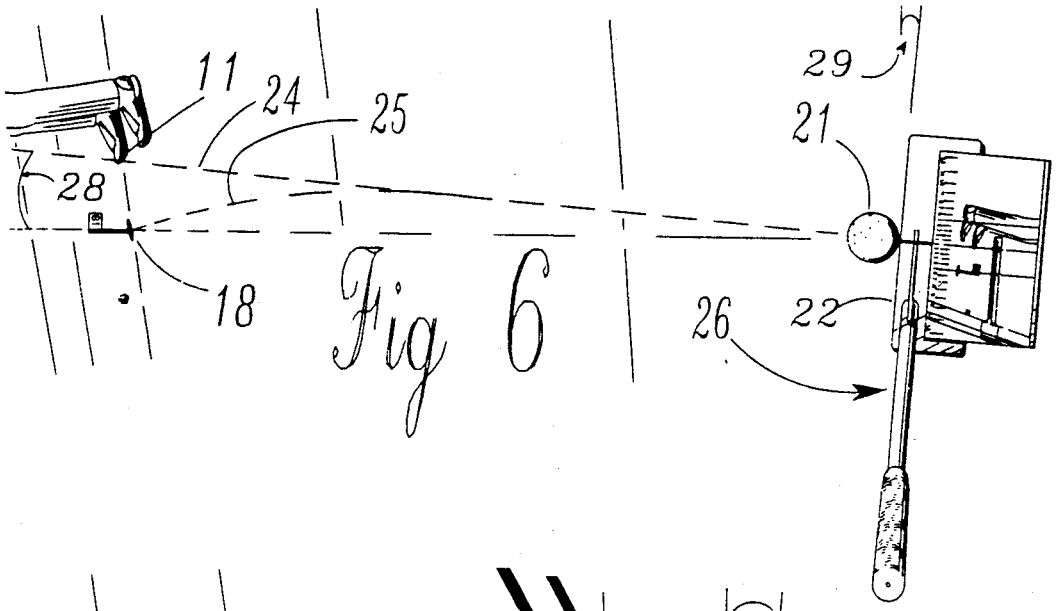

FIG. 6 discloses a right alternative target line 24 projects right of target 18. An angle 29 of striking surface of club head 22 existing right of perpendicular to target 18. This view further discloses an inclined putting surface; and subsequently, a predicted right trajectory line 25 of ball 21.

Figure 6A:
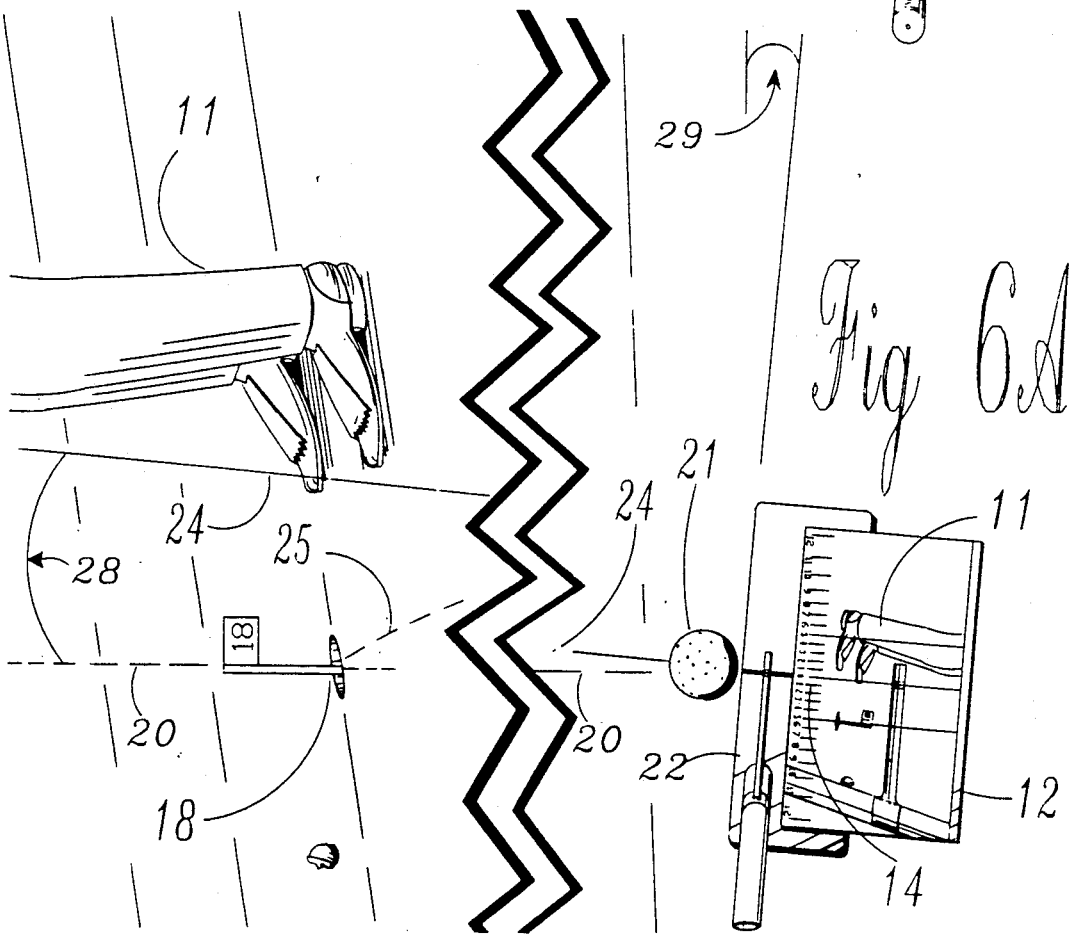

FIG. 6A further indicates how the apparatus of the present invention can detect errors in alignment at address. This is accomplished by the user viewing centering scale 14. Perpendicular alignment is achieved when zero mark of centering scale 14 is aligned with the other five previously mentioned points of reference. Compensation for inclined putting surface, can be achieved when reflection of target 18 is lined up on any numerical position other than zero of centering scale 14. This numerical position directly corresponds to the degree of compensating alignment desired. Example: The putt is being aimed at right toe of caddie 11; right alternative target line 24 is displayed by an angle 28 right of target 18. Right trajectory line 25 is predicted because of slope and break of a putting surface. Line 24 corresponds to compensation of alignment desired to negotiate a successful putt.

FIG. 7 discloses the present invention in four important phases of a correct putting stroke: (a.) an address and/or impact phase 30; (b.) a back swing phase 31; (c.) and a follow through phase 32. Striking surface of club head 22, is perpendicular to target line 20 and to reflection of target 18, in all four important phases. Note: Address and impact phases are prudently shown in the same identical position.

FIG. 8 illustrates a detection of one type of swing error that would cause an undesirable spin of a golf ball. Striking surface of club head 22 becomes deviated from perpendicular to target 18 as shown by a back swing deviation angle 33 and a follow through deviation angle 34 in back swing and follow through phases. By observing reflection of target 18 in reflective plate 12 moving away from zero of centering scale 14, any error in any phase can be detected. This observation allows a user to correct mistakes and refine putting strokes. Note: It should be obvious to one skilled in the art that the apparatus of the present invention can detect innumerable swing errors not shown.

OPERATIONAL DESCRIPTION

The following Operational Description highlights the theory and method of the preferred embodiment of three alignment components with their essential fundamental characteristics displayed. First, highlighting centering standard 15 displayed in FIGS. 2A, 3A, and 4A, of the preferred embodiment comprising a slender rigid embodiment mounted to shaft 27 in a horizontal orientation. Standard 15 is offset directly above and parallel to striking surface of club head 22. Alignment mark 16 is directly over center mark 17, on top portion of club head 22. One purpose of standard 15 is to aid the user in viewing and aligning ball 21 to alignment mark 16 and center mark 17; and achieve and ensure a consistent, reproducible, and desirable head and body posture directly over ball 21. This head and body posture technique is taught by nearly all teaching professional golfers. Centering standard 15 can alternatively be mounted from various elevations achieving the same purpose. Centering standard 15 can be made from a variety of rigid materials and/or shapes. Centering standard does not intend to be restrictive, but can be considered for alternative arrangements for the intent of the theory and method of its purposes.

Second, highlighting the scope and purpose of reflective plate 12 from FIGS. 2A and 4A comprising an embodiment made from a rigid material further comprised of a mirror quality reflective surface. FIG. 3A shows reflective plate 12 mounted to top portion of club head 22 at an angle as to accommodate user with reflection or view of target area. FIG. 4A shows base edge portion of reflective plate 12 existing parallel to striking surface of club head 22.

Third, highlighting centering scale 14 of FIG. 4A employing on either side of zero or neutral mark are progressively spaced increment marks labeling deviations of angular measurement in numerical order respectively. Increment marks depict deviation in target area, therefore, appear to be progressively spaced in silhouette. The theory and method of centering scale 14 is to detect deviations in a measurable or noticeable sense. Detection allows user to accurately align putter 27 from target 18 to accurately compensate for contour and break of putting surface. Compensations are often necessary to negotiate successful putts.

OPERATION OF FIGS.

The manner of using the sure alignment putter of the present invention to impact or putt a golf ball is the same as of conventional golf club putters. Namely, one simply swings putter 27 as to impact ball 21 with such force making ball 21 roll far enough to fall into hole or target 18. However, the manner of using sure alignment putter 27 to align user's head and eyes directly over ball 21 is novel by its design. Namely, one first makes a preliminary survey of putting surface as to note for speed, distance, and contour from ball 21 to target 18. Next, one will get in a position to execute putt by grasping putter 27. Next, one places striking surface of club head 22 behind ball 21 in generally perpendicular orientation to target 18. Further, having ball 21 aligned to center mark 17. Next, one looks down at club head 22, and further aligns one's head and eyes perfectly over ball 21 by viewing alignment mark 16 of centering standard 15 aligned to center mark 17. The procedure thus far will perfectly align golfer's head and eyes directly over ball 21. Next, while maintaining alignment, golfer 13 will rotate shaft 27 of putter 26 right or left until reflection of target 18 can be seen in reflective plate 12 aligned to reflection of alignment mark 16 of centering standard 15. When achieved, striking surface of club head 22 will be aligned perfectly perpendicular to target 18. If preliminary survey dictates a compensation necessary, one will rotate shaft 27 of putter 26 right or left, aligning reflection of target 18 to a predetermined and desired deviation mark of centering scale 14. Procedure thus far will accurately and measurably align striking surface to compensate for contours of putting surface.

The manner of using novel design of the sure alignment golf club putter of the present invention as a swing training apparatus allows for state of the art techniques of training for a complete and correct putting stroke. Namely, one uses an ordinary string or any thing to define target line 20 on putting surface to allow golfer 13 to see target line 20 in reflective plate 12. User can detect deviation of club head 22 out of alignment with target 18, and also detecting when swing arc moves out of alignment with target line 20 throughout address 30, back swing 31, impact 30, and follow-through 32 of putting stroke. On a golf course where no target line is present one simply leaves flag stick of target 18 in place; user views target 18 in reflective plate 12 with respect to users swing arc. This view will also allow golfer 13 to see deviations, thus permitting golfer 13 to make compensation for deviations. Procedures thus far will habituate golfer 13 to correct putting stroke, on or off golf course. Subsequently, through repetitive training with the apparatus of the present invention the golfer will develop proper muscle memory tone or feel for user's correct putting stroke. Many other state of the art training techniques will become apparent to those skilled in the art by further ensuring use of the apparatus of the present invention. Accordingly, the reader will see that the sure alignment putter of the present invention can easily and conveniently be used to accurately putt a golf ball to a target; and just as easily be used as a training apparatus anywhere, even touching up one's technique on the golf course putting green during the actual game. Furthermore, the sure alignment putter has additional advantages that:

allows its user to align the swing arc, of a putting stroke, along a target line;

allows its user to ensure that the striking surface of the club head is perpendicular to the target throughout the putting stroke;

allows its user to reproduce the same alignment of head and body posture in relationship to a ball every time;

allows its user to detect any deviation in stroke and alignment;

it can be used as a training aid for practicing and refining a complete and proper putting stroke without continued expense from a teaching professional's services;

it is practical for practicing on any given putting surface;

it is of simple, yet sturdy design and construction, capable of fitting any standard golf bag;

allows its user to practice and refine a correct putting stroke which, in turn, will result in consistent, more accurate and successful putting;

allows its user to discipline his focus directly over the ball;

detects deviations in alignment and allows its user to purposely and accurately align the putter, compensating for contoured putting surfaces;

allows its user to feel a proper, unrestricted putting stroke, naturally.

allows its user to accurately set up and align the putter while in a position to execute the putt being negotiated;

permits its user to have an accurate perception of a target line while in position to execute the putt; and permits the user to accurately align and putt a ball to a target.

It should be noted that the preferred embodiment and figs. show the apparatus of the present invention designed for a right-handed golfer. It should be further understood that the same embodiment manufactured in reverse of these drawings can accommodate left-handed golfers.

The description and figs. are an example of a conventional putter modified with the characteristic features of the preferred embodiment. The preferred embodiment will allow the putter to be aligned accurately to a target, and further allow novel methods of training a golfer to a proper putting stroke.

It will be understood that there can be a variety of shapes, sizes, and configurations of the present invention that will achieve the same principal, theory, and method of sighting-in the target by looking at the putter's reflective plate 12, and aligning points and means of reference. Material variations, mountings, or castings, or separate external fixtures can be manufactured separately to modify a conventional putter for the scope, principal, theory, and method of the present invention. The terms and expressions which have been employed are used as terms of description and not limitations. There is no intention in the use of such terms and expressions of excluding any equivalents of the features shown and described, or portions thereof; but it is recognized that variations and modifications are possible within the scope of the present invention. Thus the scope of the invention should be determined by the appended claims and their legal equivalents, rather than confined to the type of examples given.

I claim:

1. A golf club putter including means for aligning a ball to a flag stick, thus training a golfer for a correct putting stroke, comprising:

(i) a club head, having a smooth striking surface portion for contacting said ball, mounted to a shaft means at one end, having a grip means at other end of said shaft whereby permitting said golfer to grasp, address, align said club head;

(ii) a reflective plate means mounted to the top general center portion of said club head, having said reflective plates' top edge portion angled back from vertical, away from said striking surface whereby permitting said golfer to observe a reflection of a target area; and (iii) a centering standard means mounted to said shaft means and extending, horizontally parallel, over said club head, whereby said golfer will be able to view a reflection of said centering standards horizontal orientation in said reflective plate.

2. A golf club putter according to claims 1 wherein said club head further comprises a center mark on the top generally central portion of said club head in a perpendicular orientation to said striking surface portion for positioning said golf ball relative said striking surface portion.

3. A golf club putter according to claim 1 wherein said centering standard means comprises a generally slender rigid element extending past said center mark and includes at least one alignment mark directly above said center mark so that a golfer's head and eyes may be aligned over a golf ball being putted.

4. A golf putter according to claim 3 wherein said reflective plate means includes a pluraltiy of marks constituting an increment scale of angular measurement having a zero or neutral mark in line with said center mark and said alignment mark and in a perpendicular orientation to said striking surface portion of said club head.

* * * * *